United States Patent [19]

Braxton

[11] 4,141,006

[45] Feb. 20, 1979

[54] SECURITY SYSTEM FOR CENTRALIZED MONITORING AND SELECTIVE REPORTING OF REMOTE ALARM CONDITIONS

[76] Inventor: Kenneth J. Braxton, 312 Astoria Rd., Springfield, Ill. 62704

[21] Appl. No.: 705,357

[22] Filed: Jul. 14, 1976

[51] Int. Cl.[2] ..... G08B 19/00

[52] U.S. Cl. ..... 340/505; 179/5 R; 340/524; 340/541; 340/584

[58] Field of Search ..... 340/408, 164 R, 310 R, 340/416, 420, 213 R, 213 Q, 213.1, 276, 227 R; 179/5 R

[56] References Cited

U.S. PATENT DOCUMENTS

| | | | |
|---|---|---|---|
| 3,641,530 | 2/1972 | Schoenwitz | 340/213 Q |
| 3,842,208 | 10/1974 | Paraskevakos | 179/5 R |
| 3,855,456 | 12/1974 | Summers et al. | 340/223 |
| 4,001,785 | 1/1977 | Miyazaki et al. | 340/213 Q |

*Primary Examiner*—Glen R. Swann, III
*Attorney, Agent, or Firm*—Grace J. Fishel

[57] ABSTRACT

A security system consists of a central digital processor system, e.g., a general purpose computer, to which plural remote units are connected by a digital communications link, e.g., telephone. The remote units include plural alarm sensors such as intrusion and heat sensors. In a data base of the central processor system are stored segments of data associated uniquely with remote premises having the remote units. The processor system includes a terminal for delivering alarm message reports, such as to a law enforcement agency. Specifically, the remote units have interrogation circuitry for interrogating the sensors to determine if they have been tripped, logic circuitry for causing transmission to the central processor system via the communications link of a sensor alarm data message in digital format signifying the sensor address and its tripped status. The central processor system includes correlation means for correlating the data message with the data base to determine logical validity or invalidity of the message. Means responsive to logical validity determination causes portions of the data message and corresponding segments of the data base to be assembled into an alarm message report for delivery by said terminal.

27 Claims, 8 Drawing Figures

SECURITY SYSTEM FOR CENTRALIZED MONITORING AND SELECTIVE REPORTING OF REMOTE ALARM CONDITIONS su

BACKGROUND OF THE INVENTION

The invention relates to centrally monitored security or alarm systems and more particularly to systems for centralized monitoring and selective reporting of alarm conditions at plural remote premises, especially over a wide geographic area.

Many security, alarm or annunciator systems which employ central monitoring of conditions at remote locations have been known or have been described in the general and patent literature in recent years.

One such system is disclosed in Streit U.S. Pat. No. 3,523,162 which teaches plural remote stations each having one or more alarm sensors and a power supply for causing an alarm signal generator (i.e., a relay) to signal a corresponding one of plural central alarm units by means of a telephone line if the sensor is tripped.

A more sophisticated system disclosed by Hardy et al. U.S. Pat. No. 3,761,914 is designed for use with a community antenna (cable) television system (CATV) employing the concept of RF signaling a central office from remote premises via the cable network of alarm (e.g., fire or intrusion) conditions. For this purpose, the remote units send a coded signal. That system includes provision for ascertaining at the central office whether the system is operational or not.

Even more sophistication is represented by systems employed for process monitoring (annunciator systems) much as taught by Judlowe U.S. Pat. No. 3,686,654 wherein a plurality of remote solid state alarm modules are each interconnected with a central facility which includes a recorder for recording the operation of either continuous (analog) or switch-type parameter sensing transducers at the remote modules.

A multiple point alarm system having a number of alarm points arranged in groups or zones at areas remote from a central station is disclosed by Nurnberg et al. U.S. Pat. No. 3,714,646. That system includes plural zone encoders connected to the alarm switches which signal a zone identification circuit for the purpose of identifying the group or zone in which even a momentary alarm condition occurs.

Neuner U.S. Pat. No. 3,855,590 describes a cyclic or monitoring system involving monitoring of plural remote process sensors from a central facility. For this purpose two data or logic streams are sent to the central facility, one of the streams being sent to a control room for operator use, the other being supplied to a special purpose computer used for controlling the facility (i.e., a nuclear power plant) which is supervised by the monitoring system disclosed.

Perhaps the most sophisticated of the systems presently described in this background discussion is the monitor and results computer system disclosed by Summers et al. U.S. Pat. No. 3,855,456. That system is intended for aiding operation of processes occurring in a power generations plant. The system employs a logging technique for transforming input data from a plurality of scanned pickup points or sensors into a system variable format usable by all system functions. The computer features serve to store and organize the data in accordance on the delays associated with the sensed events or conditions. This allows the correct order of occurrence of events, etc., to be provided either by CRT devices, alphanumeric and graphic displays, or printers and plotters. Thus the computer organizes the incoming data into usable messages.

These various systems representative of the prior art fail to provide one or more of the following characteristics which are desirable for a security system capable of satisfying present needs in a multiuser social environment.

In the wake of today's increasing crime rate there is much need for a system capable of monitoring crime and fires. However, law enforcement agencies recite endless reports of false alarms triggered by equipment failures, unwise and careless installations. The false alarm situation has become such a nuisance in some cites, police and fire departments refuse to respond to an unverified alarm from a home or office protection system. Uneducated and inexperienced installers in the field of electronics, poorly or wrongly designed systems, substandard equipment and materials, and lack of training of the prospective user in how to use the system are the major factors that have produced the majority of false alarms. Thus, it is desirable that a security system be capable of verifying in some way the validity of the alarm condition which is being reported to a central facility from a remote unit at a subscriber's premises.

It is also desirable that a security system be extensible to a wide geographic area and, for this purpose and for other reasons, employ a common carrier serving intended users. For example, the concept of using existing common carrier facilities expands the availability of existing communications services to potential users or subscribers of the available common carrier serving their respective communities.

Other key attributes desirably present in a centrally monitored security system are that it be useful for both small and large subscribers; that it be readily expandible; that it be capable of responding to operation of various possible forms of sensors (e.g., intrusion, fire, heat, water, etc.); that it be responsive to short-term or momentary alarm conditions; that it identify the location of a premise having alarm conditions and specific sensors which sense alarm conditions; that its central facility not be easily overloaded by plural alarm condition reports; that it automatically keep records of vital alarm information; that it automatically keep track of changes in the operational status of subscriber units, i.e., remote units; that it require no constant, direct human monitoring and yet provide specific alarm messages useful for human intervention in alarm conditions; that it provide a high reliability, operational security, and speed; and that it be economical.

SUMMARY OF THE INVENTION

Among the several objects of the invention may be noted the provision of a centrally monitored security system; the provision of such a system which is extensible over a wide geographic area, which is readily expandible, and well-suited to large and small subscribers; the provision of such a system which employs common carrier communication links between remote units at subscriber premises and a central monitoring facility; the provision of such a system which is responsive to operation of various possible forms of sensors and to short-term or momentary operation of such sensors; the provision of such a system which can identify not only the location of premises with alarm conditions, but also the specific sensors which sense these conditions; the provision of such a system which is not easily overloaded by plural alarm condition reports; the provision of such a system which not only maintains automatic records of vital alarm information but also automatically keeps track of changes in the operational status of subscribers (remote) units, the provision of such a system which is electronically automatic in character, requiring no constant, direct human monitoring, yet which provides specific alarm messages useful for human intervention in alarm conditions; the provision of such a system which can also automatically provide messages indicative of invalid alarm condition data supplied to the central facility; and the provision of such a system having capability for extremely high reliability, operational security, speed and economy.

In its apparatus aspects, the invention relates to a security system for centralized monitoring and selective reporting of alarm conditions at a plurality of distant remote units at corresponding remote premises. The system includes a central digital processor system for digitally processing information received from remote units and a communications system adapted for providing a digital communications link between the central processor system and any of the remote units.

The central processor system includes a plurality of input ports to provide for simultaneous receipt of alarm data from more than one of the remote units. A data base is maintained at the central processor system. This data base is constituted by segments of stored preselected data, corresponding segments being indicative of characteristics associated uniquely with corresponding remote premises. The remote units individually adapted for responding to a plurality of sensors each having a normal status or a tripped status, the tripped condition resulting in response to occurrence of an alarm situation, such an intrusion or the presence of heat, smoke, fire or water. The central processor system has at least one output port to provide for delivery of alarm message reports to an output terminal device in a format useful for human intervention in such alarm situation.

Specifically, interrogation means at individual remote units interrogate the sensors for detection of whether any sensor has changed from normal status to tripped status. Memory means at individual remote units are provided for storing sensor data signifying the address and tripped status of each tripped sensor. Communications initiation means at individual remote units, operative upon detection of such change in sensor status, is included for initiating the establishment of a communications link by the communications system between one of the input ports of the central processor system and the respective remote unit. Encoders at individual remote units encode, when enabled, said stored sensor data in a digital format suitable for transmission over the communications link. Message initiation circuitry at individual remote units is operative upon establishment of a communications link to enable the encoder for transmitting said stored sensor data as a sensor alarm message to the central processor system via the communications link.

Message storage means at the central processor system stores the transmitted sensory alarm data message. Correlator means at the central processor system logically correlates the stored sensor data message with corresponding segments of said data base to determine logical validity or invalidity of the sensor alarm data message.

Invalid message processing means is responsive to a logical invalidity determination for signaling that the sensor alarm data message is erroneous but valid message processing means is responsive to a logical validity determination for causing at least portions of the sensor alarm data message and corresponding segments of the data base to be assembled into an alarm message report for delivery by said output port.

In its method or process aspects, the invention is concerned with a method of centralized monitoring and selective reporting of alarm conditions at the corresponding remote premises. The method involves providing each of a plurality of the remote premises with at least one electronic remote unit and a plurality of sensors associated with such remote unit. The sensors each having a normal status or a tripped status, the tripped status resulting in response to an alarm situation. This method further contemplates providing a central processor system including data base storage, storing in the data base storage segments of preselected data associated uniquely with corresponding remote premises and providing a digital communications link between the central processor system and any of the remote units.

More specifically, it involves, electronically interrogating the sensors to determine if any sensor has changed from normal status to tripped status electronically detecting such change in sensor status, and electronically storing data signifying the address and tripped status of each tripped sensor. Communications readiness of the digital communications link is then electronically initiated upon detection of such change in sensor status. Then, the stored sensor data is electronically encoded in a digital format suitable for transmission over the communications link and electronically transmitted as a sensor alarm data message to the central processor system via said communications link.

At the central processor system, the received sensor data message central processor system is electronically stored and thereafter is electronically logically correlated by the processor system with corresponding segments of the data base to electronically determine logical validity or invalidity of the sensor alarm data message. Then, what occurs is one of two alternatives. One is electronically signalling upon electronically determining that said sensor data message is logically invalid, that the sensor alarm data message is erroneous. The other alternative, upon electronically determining that the sensor alarm data message is logically valid, is electronically causing at least portions of the sensor alarm data message and corresponding blocks of said data base to be provided as an alarm message report in a format useful for human intervention in such alarm situation.

BRIEF DESCRIPTION OF THE DRAWINGS

Corresponding reference characters indicate corresponding elements throughout the several views of the drawings.

DESCRIPTION OF THE PREFERRED EMBODIMENTS

Figure 1A:
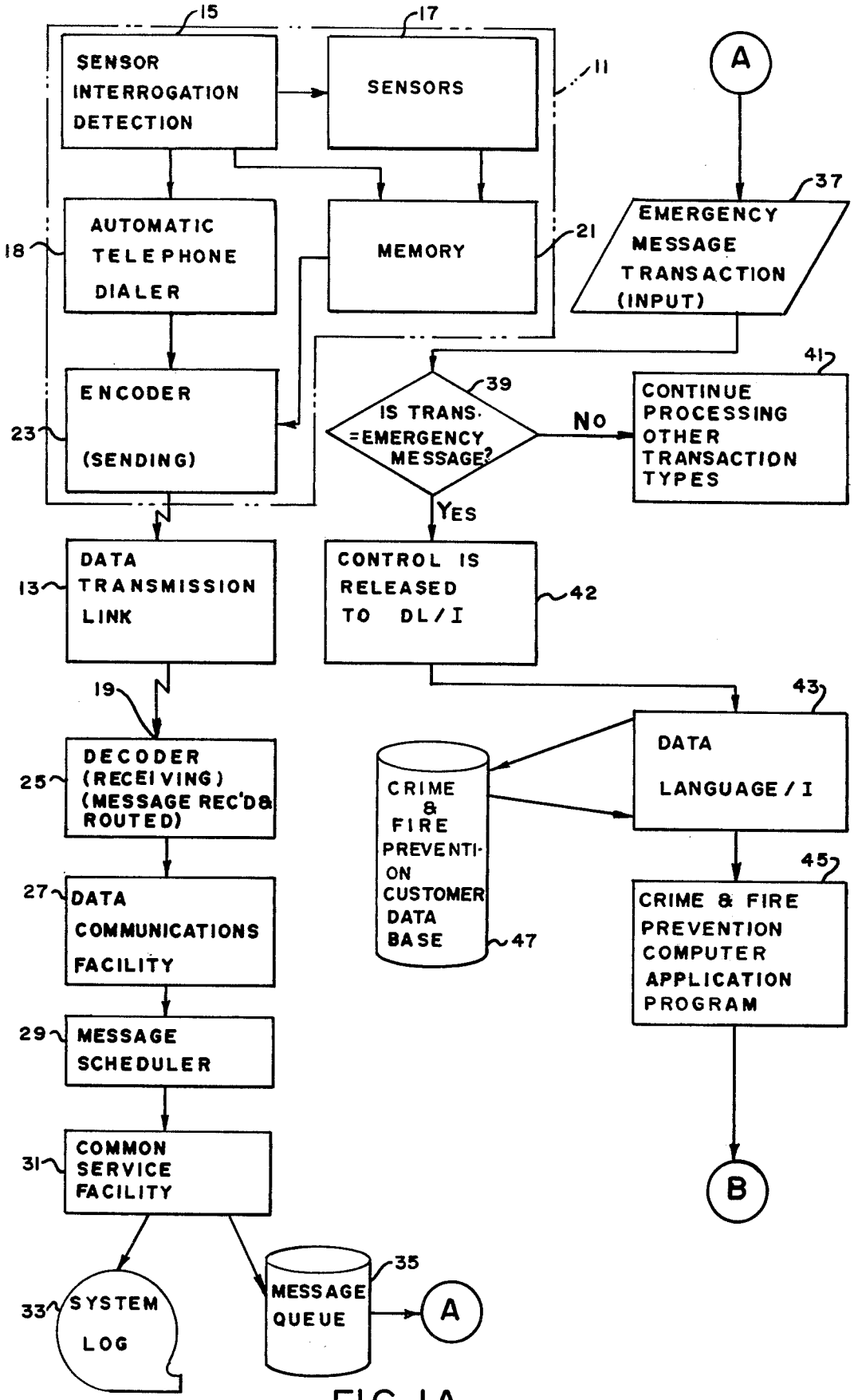
FIGS. 1A–1C together represent a flow diagram illustrative not only of operation of the system but also its elements, interconnecting portions of the diagram being indicated by alphabetic characters.

Referring to FIG. 1A, indicated at 11 is one of a plurality of electronic remote units of the present security system. Each remote unit 11 is located at the corresponding premises of a subscriber to the system which premises are relatively remote, e.g., geographically separated by up to many miles, from central digital processor facilities of the present security system, there being no interconnection between any of the remote units 11 and the central processor facilities except through a common carrier communications link 13 (such as a telephone circuit) explained below.

Each remote unit 11 includes circuitry 15 for interrogating each of a plurality of switch-type sensors 17 positioned suitably on the subscriber's premises for detecting any of various alarm conditions such as intrusion, fire, heat, water, etc. The purpose of such interrogation is for detecting whether any of the sensors 17 has changed from a normal status to a tripped status, such tripped condition resulting from occurrence of an alarm situation (alarm condition). Within the block designated 18 is communications initiation means, e.g., an automatic telephone dialer, operative upon detection of such change in sensor status, for initiating the establishment of communications link 13 between one of the possibly several input ports 19 of the central processor system and remote unit 11.

At 21 is a memory of remote unit 11 which serves as means for storing sensor data signifying the address (i.e., location on the premises) and tripped status of each of sensors 17 which have been tripped. An encoder shown at 23 serves as means for encoding, when enabled, said stored sensor data in a digital format suitable for transmission over communications link 13. Circuitry within block 15 serves constitutes message initiation means, operative upon establishment by dialer 18 of communications link 13, to enable encoder 23 for transmitting said stored sensor data as a sensor alarm data message to the central processor system over link 13.

The central digital processor system which is preferred is of the type generally disclosed in Amdahl et al. U.S. Pat. No. 3,400,371, entitled "Data Processing System" herein incorporated by reference and more preferably an improved data processing system such as System/370 models 145, 155 II, 158, 165 II, or 168, commercially available from International Business Machines Corporation. For this purpose, it is preferred to use an Information Management System/Virtual Storage (IMS/VS) control system in order to implement the present invention when employing one of the above models, but others may be used.

Figures 1B, 2:
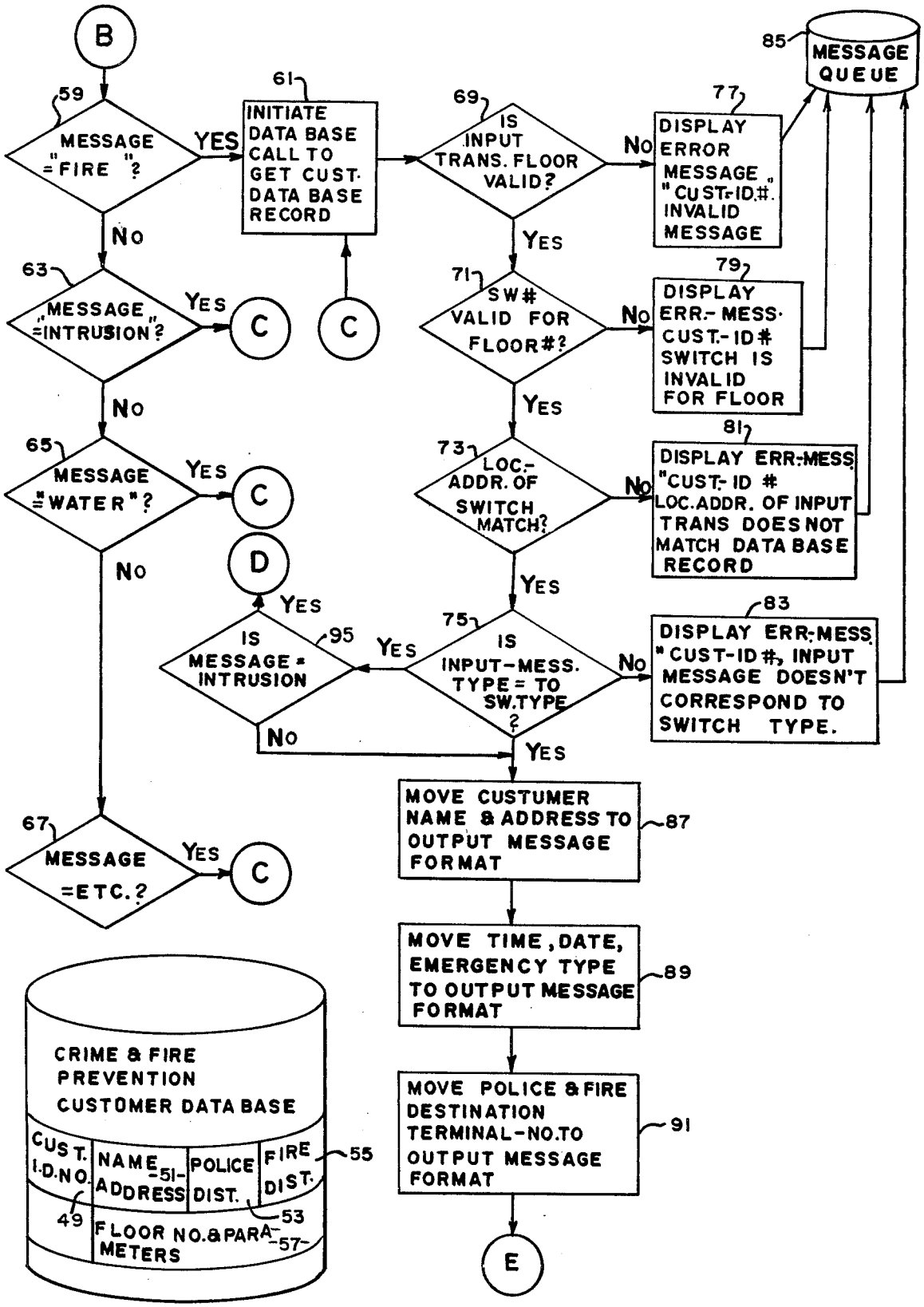
FIG. 2 is a symbolic representation of a data base of a central processor system of the invention.
Figure 1C:
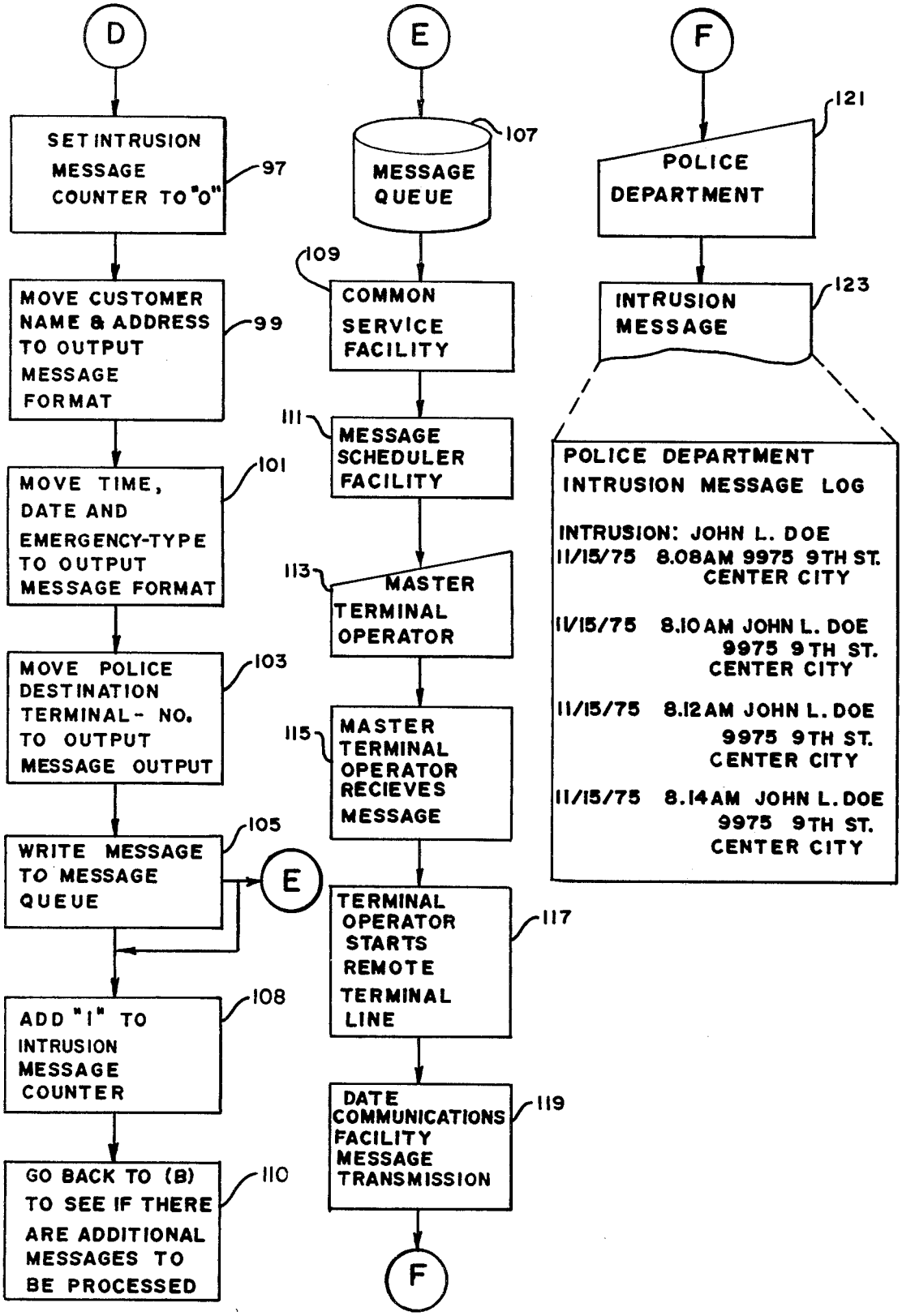

Referring again to FIG. 1A and also to FIGS. 1B and 1C, the central processor system includes a suitable decoder 25 for decoding the data received over link 13 and for converting it to an electronic format compatible with the processor system. At 27 is shown a data communications facility serving as symbolic program linkage between the communications terminal constituted by decoder 25 and the remainder of the processor system.

The received sensor alarm data message flows from facility 27 to a message scheduler 29 serving as a message processing region or partition of the processor system for defining message priority, size, or class. In this way priorities can be set for different types of data messages in the event of high data message activity. Such operation will be understood by those skilled in the art of using advanced digital processing systems.

A common service facility 31 makes the incoming data available to both a system log 33 and to a message queue 35. Thus the input data is both logged and queued for further processing. This arrangement provides message storage means for storing the sensor alarm data message. It may be noted that all input (and output) messages are electronically written in log 33 to ensure an ability to preserve data, and ensure an ability to restart the system, in the event of a system failure, such as loss of power, or in the event of deliberate processor system shutdown.

Processing by the processor system of the sensor alarm data message is deemed to begin in FIG. 1A at the input designated 37. It should here be understood that various data transactions may be taking place within the processor system. For this purpose, a sensor alarm data message arriving at input 37 is deemed an emergency message. A determination then results at decision point 39 as to whether the received data represents an emergency message transaction. If the determination is "no," the processor system continues processing other transaction types as shown at 41.

If the determination at 39 is "yes," control of the emergency message (i.e., the sensor alarm data message) is released as indicated at 42 to Data Language/I (DL/I), a data management facility through which the IMS/VS control system is adapted to the data requirements of the present security system. DL/I, designated at 43, provides the present crime and fire, etc., prevention application program 45 with a facility to use a crime and fire, etc., customer (subscriber) data base 47 as described below. DL/I can also be used to assist in the creation and maintenance (e.g., updating of subscriber information) of data base 47, as well as for other purposes which will be understood to those skilled in the art of using advanced digital processing systems such as those identified above and similar types.

Data base 47 is provided by electronically storing segments of preselected data associated uniquely with corresponding subscriber remote premises. Referring to FIG. 2, data base 47 is shown to include for each such subscriber (customer) a record including an identification number 49, the subscriber's name and address 51, police district 53, fire district 55, as well as various parameters 57 which are helpfully descriptive of the subscriber's premises and location on the premises of the various sensors 17. For example, a heat sensor location in a bedroom on the third floor, or a door intrusion sensor in the basement may be so identified.

Once into the security program 45, the sensor alarm data message undergoes several decisional processing steps, herein referred to simply as determinations. Thus, referring again to FIG. 1B, a determination is made at 59 as to whether the message indicates a fire. If "yes," the program initiates (as shown at 61) a call to data base 47 to get the customer's data base record for further processing as described below.

If the message does not indicate a fire, a determination is made at 63 as to whether it indicates an intrusion. If It does, the program initiates a data base call as shown at 61. If it does not, a determination is then made at 65 as to whether the message indicates that presence of water has been sensed. If the message so indicates water, a data base call is initiated as shown at 61. If it does not so indicate, a further determination is made at 67 as to whether the data signifies some other alarm occurence (e.g., excessive heat, overpressure and so forth). If so, a data base call is initiated as shown at 61.

Assuming that one of the above determination results in a data base call 61, further determinations are made by the program with the use of the data base record. At 69 a determination is made (by comparison of the alarm message with the data base) of whether the floor number identified in the alarm message as the location of the sensed alarm occurence is logically valid. For example, a reported intrusion on the third floor could be valid if the premises from which the message was received is indicated in the data base as having an intrusion sensor on the third floor of the premises but would not be valid if the data base held no record of an intrusion sensor on third floor.

Then, if the transmitted floor message input is determined to be valid, a determination is made at 71 as to whether the switch (sensor) number input is logically valid on the basis of the switch (sensor) numbers in the data base. If so, a further determination is made at 73 as to whether the location or address of the sensor (e.g., "hallway No. 3 sensor") matches information in the data base. If so, a further determination is made at 75 as to whether the type of alarm occurence reported by the data message corresponds to the type of sensors which the data base indicates are present at the premises.

If the answer to any of determinations 69, 71, 73, or 75 is "no," a corresponding appropriate error message action 77, 79, 81 or 83 is taken. Such error messages signify, for example, that a malfunction has occurred in the sensors of a customer or elsewhere in the remote unit, for example. All such error messages are electronically written by the program to a message queue 85 from which they can be sent to the master terminal operator (or elsewhere) for notifying the customer or service personnel of the malfunction.

If the answer to each of determinations 69, 71, 73, and 75 is "yes," the program moves the customer's name and address to output message format as shown at 87. Then the program moves the time, date and emergency (alarm occurrence) type to message format as indicated at 89. Finally, it moves a police and/or fire destination terminal number to output message format as signified at 91 for further processing.

Note that if the determination at decision point 75 is "yes," a further determination is made at 95 as to whether the alarm data message signals that an intrusion has been made. If "yes," further steps are taken as shown in FIG. 1C.

Referring to FIG. 1C, a first such step 97 is to set a message intrusion counter to the processing system to zero. Then, as indicated at 99, the customer's name and address are moved to output message format. Next, the time, date and type of emergency (alarm occurrence type) are moved to output message format, as shown at 101. Finally, at 103, a police destination terminal number is moved to output message format.

The completed message is written, as represented at 105, to a message queue 107 for further processing described below. When the message is written to queue 107, a count of one is added to the intrusion counter, as indicated at 108, whereupon the program is structured as represented at 110 to go back to point "B" (See FIG. 1B) of the program to see if there are any additional messages to be processed, the intrusion counter being incremented accordingly.

From message queue 107, messages flow conventionally to a common service facility 109 and thence to a message scheduler facility 111 for delivery to a message terminal operator 113. Receiving of the alarm, i.e., emergency message is indicated at 115. The terminal operator starts a remote terminal line as shown at 117. Then, data communications facility message transmission occurs as represented at 119.

A police department is illustrated at 121 as receiving the alarm message report, here represented at 123 as an intrusion message report. For this purpose, police department 121 may have a conventional on-line printer terminal.

It should be understood that if the alarm message is of a nonintrusion type, i.e., a fire, heat, water, etc., message, then the alarm message report would be sent to a fire department instead, but in a manner identical with that just described. Such nonintrusion alarm message reports may be provided simultaneously also to a police department.

Although the intrusion message report is shown at 123 is represented as showing the name and address of the customer, as well as the date and times of intrusions sensed, it will be apparent that other information may additionally be reported, such as specific locations of the tripped sensors, or additional customer data such as type of premises and other especially useful types of information in data base 47.

Referring to FIGS. 3A–3D, circuitry of a remote unit 11 of the system is shown in detail. In the interest of clarity, not all of the various conventional power supply or similar connections are illustrated.

The various circuits and logic devices described herein may be advantageously comprise monolithic integrated circuits. While integrated circuit devices of discrete commercial types as described may be employed, it will be apparent that circuitry as described herein may be of the large scale integration (LSI) type.

Various logic gates or digital devices of the type described herein having outputs which are logical functions of the inputs thereto are said to supply an output signal when the respective output or input is at a first distinct voltage or current level (a "1" state) as opposed to a second distinct voltage or current level (a "0" state). Positive logic is assumed.

Figure 3A:
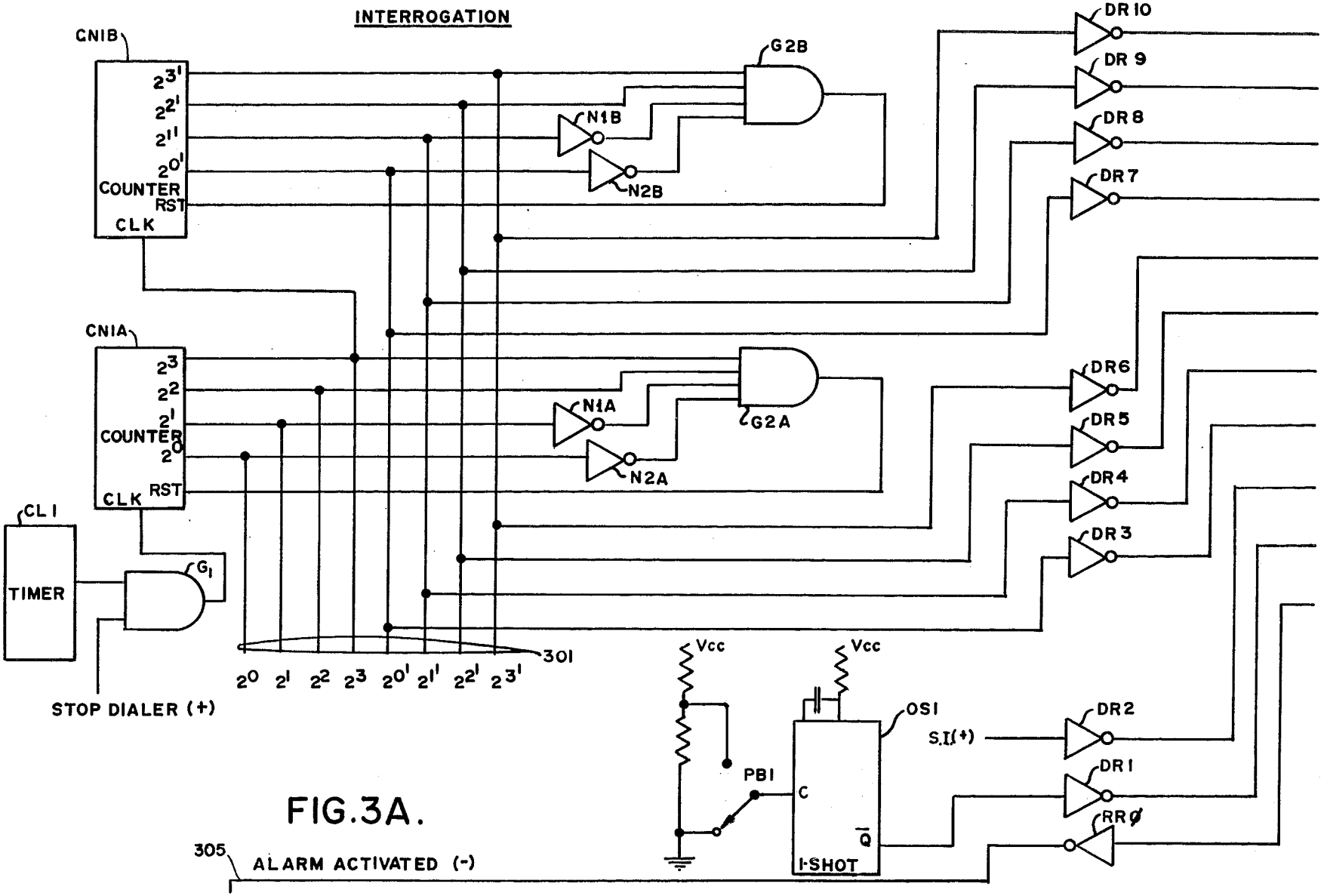
FIGS. 3A–3D together constitute a schematic diagram of circuitry of a remote unit of the invention, circuits, interconnections being identified by the alignment of leads.
Figure 3B:
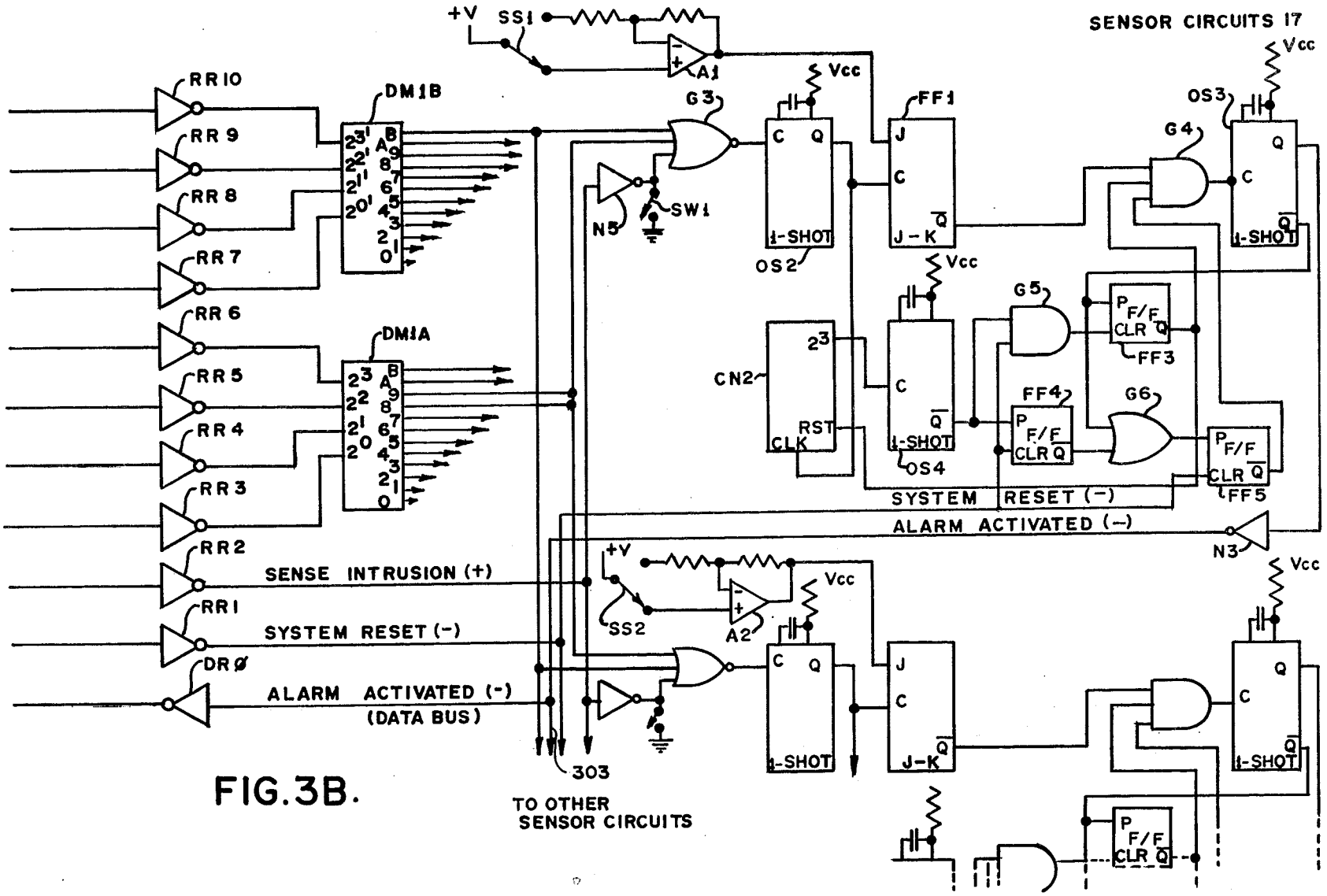

Two sensor switches ("Sensors") SS1 and SS2 are shown in FIG. 3B. These are but two of the many possible sensors, a convenient maximum number for this configuration of the remote unit being one hundred forty-four. Such sensors may be of either normally-open (n.o.) or normally-closed (n.c.) types, it being understood that the respective sensor is moved from its normal position or status and thus attains a tripped status or condition in response to occurence of an alarm condition.

One side of each such sensor SS1, SS2 is connected to either the inverting or noninverting input of a corresponding operational amplifier A1, A2, depending upon whether the sensor type is n.c. or n.c. A suitable d.c. potential +V is supplied to the other side of the respective sensor.

Each of the sensors has identical logic circuits associated with it, as is suggested by dotted-line portions of circuits associated with sensor SS2. Thus only circuits associated with sensor SS1 are described in detail. Operation of such logic circuits is described below, since it is appropriate first to consider certain circuit features for interrogating the sensors.

The interrogation circuits include a source CL1 of clock pulses constituted, for example, by an astable multivibrator oscillating at a suitable frequency such as 150Hz. Such pulses are gated through a 2-input AND gate G1 to the first of a chain of two 4-bit binary counters CN1A and CN1B.

Logic decoder circuits including a pair of logic-inverting amplifiers N1A and N2A and a 4-input AND gate G2A are connected across the outputs of counter CN1A for resetting it to zero upon counting the 13th pulse. An identical reset circuit is connected to counter CN1B. Hence, the counter chain may count to a total of 144.

The counter outputs are made available at 301 for interrogating memory circuits described below and are also supplied to respective data bus drivers DR3–DR10 (constituted by inverting amplifiers for the purpose of sending interrogation addresses to the sensors and their co-located associated logic circuits (hereinafter "sensor circuits") it being understood that such sensors and associated circuits may, if desired, be located on the premises at considerable distance from the interrogation circuits and other portions of the remote unit, and the logic circuits may be in the form of self-contained modules.

Associated with the above data bus drivers are additional data bus drivers DR1 and DR2. Driver DR2 transmits to the sensor circuits a signal SENSE INTRUSION (+) generated as described below by circuits of FIG. 3D for activating the sensor circuits. Driver DR1 transmits to the sensor circuits the output of a one-shot multivibrator or flip-flop OS1 for resetting the sensor circuits each time a pushbutton switch PB1 is operated.

Data bus receivers RR1–RR10 (constituted by inverting amplifiers) are interconnected with corresponding ones of drivers DR1–DR10 and provide binary sensor address data to a pair of four-bit input hexadecimal output demultiplexers DM1A and DM1B. By selectively connecting one output of each demultiplexer to individual sensor circuits, a unique address for each sensor is defined. For example, sensor SS1 has an address defined by the "9" output of DM1A and by the "B" output of DM1B. However, the outputs of the demultiplexers may be connected in a random pattern to the sensor circuits to avoid an easily-determined interrogation sequence. In such an arrangement, each sensor is interrogated in sequence but in a randomized pattern. Since timer CL1 operates at 150Hz, all the sensors are interrogated within less than a second, such interrogation being repeated continuously, of course.

Interrogation of sensor SS1 occurs when its address (provided by the demultiplexer outputs) is detected by a 3-input NOR gate G3, the output of which goes high when all of its inputs are low. This triggers a one-shot multivibrator OS2 and, if sensor SS1 was tripped during the interrogation or is, at this time, tripped even momentarily, the resultant signal is clocked by OS2 through a flip-flop, FF1 and, in inverted logic, is presented by the $\bar{Q}$ output of FF1 to a 3-input AND gate G4 for clocking a one-shot multivibrator OS3. When clocked, its $\bar{Q}$ output goes momentarily high. This signal is then inverted by an inverter N3 to provide a signal referred to as ALARM ACTIVATED (−). This inverted-logic signal is thus representative of detection of a tripped sensor. It is supplied through a bus 303 common to all the sensor circuits to a data bus driver DRϕ (an inverter) is in turn received by a data bus receiver RRϕ (an inverter) and thence delivered by a line 305 to the circuitry of FIG. 3C, where it is again inverted by an inverter N4 for further use explained below.

Referring again to FIG. 3B, when one-shot OS3 is clocked, its $\bar{Q}$ output momentarily goes low, causing the $\bar{Q}$ output of flip-flop FF3 to go low. This produces a low input for AND gate G4 to preclude further clocking of one-shot OS3 and prevents another ALARM ACTIVATED signal, for the time being. Designated CN2 is a 4-bit binary counter clocked by one-shot OS2. Hence, it counts the number of interrogations of sensor SS1. The output $2^3$ (corresponding to eight interrogations) of this counter is interconnected with the clock input of a one-shot multivibrator OS4 having its $\bar{Q}$ output interconnected with one input of a 2-input AND gate G5. The other input of G5 is ordinarily high until a SYSTEM RESET (−) signal results from reset operation explained below.

Operation of the logic elements just described has the result of allowing one-shot OS3 to be clocked for a second time only after eight interrogations of sensor SS1 have occurred. This period is preselected to be long enough to allow any data stored in later-described memory elements of FIG. 3C first to be transmitted to the central processor system. When a second alarm activation signal from sensor SS1 is thus given, a 2-input OR gate G6 and two flip-flops FF4 and FF5 act to prevent the output of gate G4 from again going high until a SYSTEM RESET (−) signal is provided.

Accordingly, this circuitry operates not only to permit only a predetermined number (two) of tripped sensor occurences to be reported, but also provides for a predetermined time delay between them. This ensures high reliability in reporting the alarm occurrence detected by the sensor but precludes undesirably redundant reports from the same sensor while enabling all stored data to be forwarded promptly to the central processor system.

While still referring to the sensor circuits, it should be observed that each sensor circuit is provided with a switch SW1 which, when selectively closed, grounds an input of NOR gate G3. In this closed position, the sensor operates as a nonintrusion type. Thus, this switch is closed if the sensor is employed, for example, for detecting fire. If the sensor is an intrusion-sensing type, then switch SW1 is opened and an inverter N5 provides a signal SENSE INTRUSION (+), when present, to this input. This signal is supplied when the remote unit is being employed in its intrusion sensing mode which mode, as explained in the description below of circuity of FIG. 3D, may be selectively disabled.

Figure 3C:
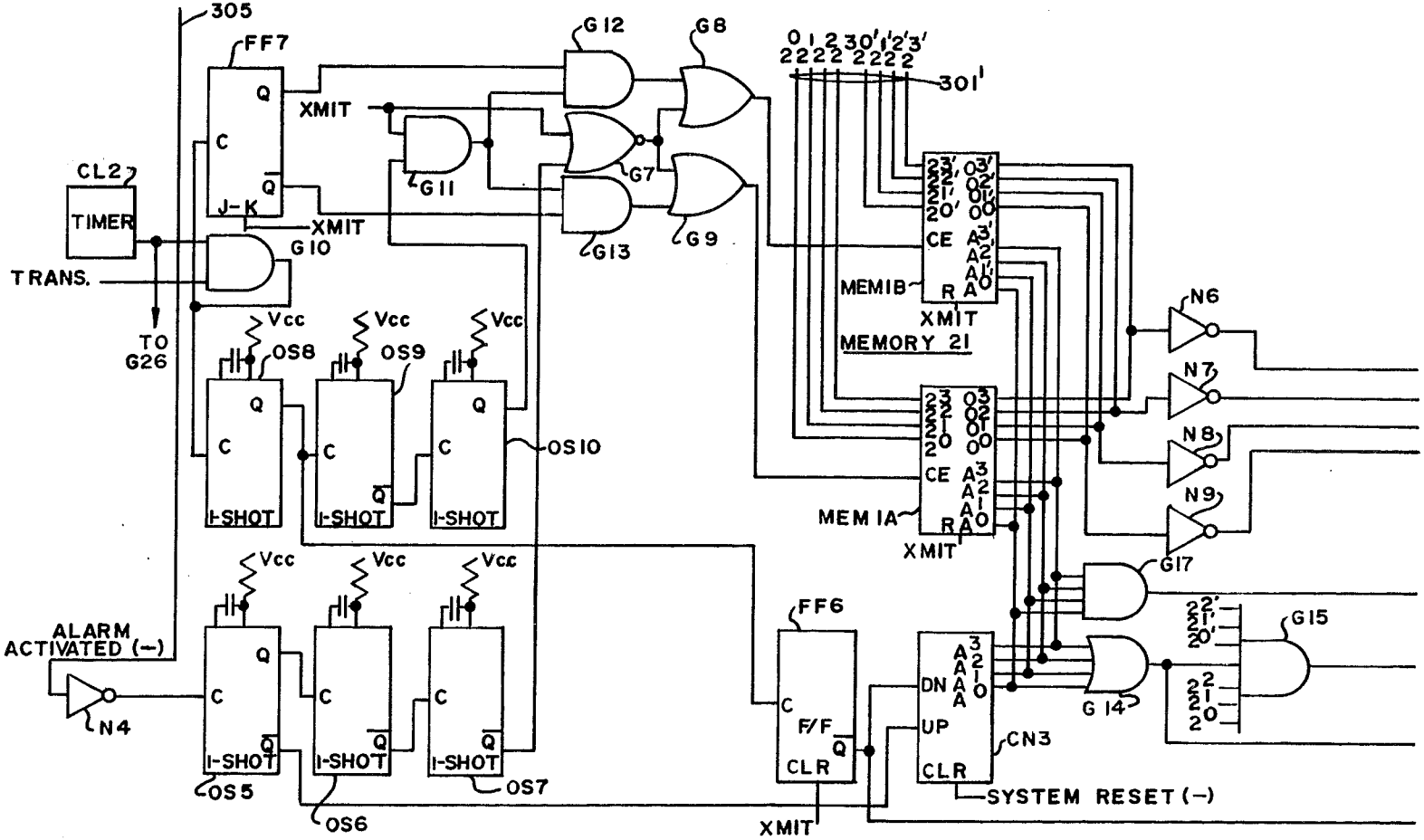
Figure 3D:
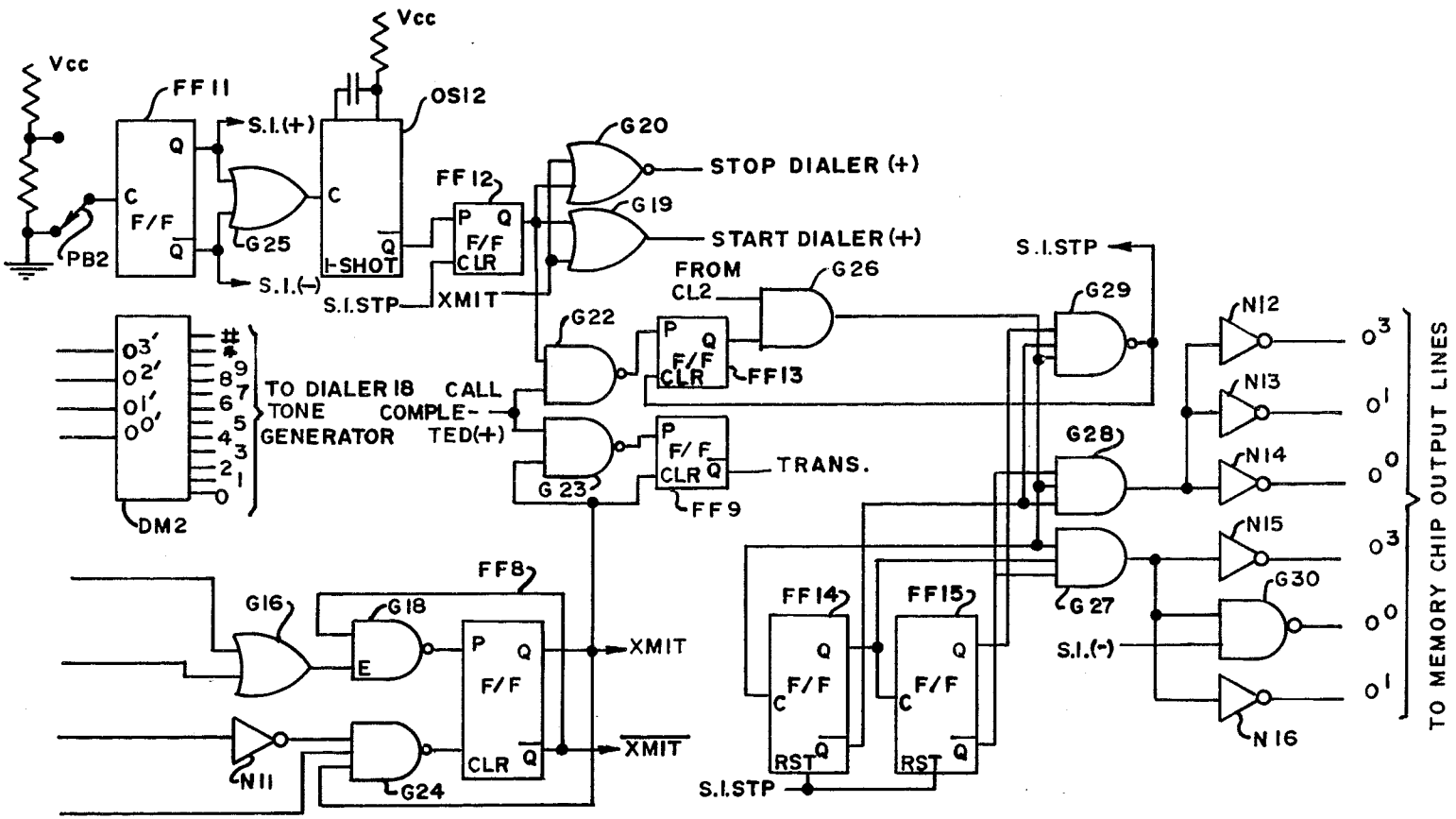

Referring now to FIG. 3C, the signal ALARM ACTIVATED (−) clocks a first of three one-shots OS5, OS6, and OS7 cascaded to provide a timing sequence. When, as a result, the $\bar{Q}$ output of one-shot OS7 goes low, a signal is provided by a 2-input NOR gate G7 and a pair of OR gates G8 and G9 to the chip enable input ("CE") input of each of two 16-word, 4-bit random-access memories MEM1A and MEM1B.

Note that the sensor addresses are also made available as input to each of the memories, as shown at 301', from counters CN1A and CN1B. Thus, loaded into the memories are the addresses of each of the sensors which have been tripped. This stored data therefore signifies the tripped status of such sensors and their address data.

Each memory has a read input designated "R" which must be low for such data to be stored in the memories. This input goes high in response to a signal XMIT signifying that the data is to be transmitted to the central processor system.

The $\overline{Q}$ output of one-shot OS5 is seen to be provided to the up-count input of a binary counter CN3 so that this counter counts the number of tripped sensors which are detected during an interrogation cycle.

Designated CL2 is an astable multivabrator oscillating at a relatively low frequency such as about 3Hz (up to perhaps 30Hz) to provide clock pulses which are gated by a 2-input AND gate G10 when a signal TRANS (described below) is provided thereto, and then are delivered to the first of a time-delay cascade of one-shots OS8, OS9 and OS10.

The Q output of OS8 is interconnected with the clock input of a flip-flop FF6 having its $\overline{Q}$ output connected to the down-count input of counter CN3 for the purpose of de-incrementing the count in this counter as the data signifying each tripped sensor is transferred to the central processor system. The Q output of one-shot OS10 is interconnected with an input of an AND gate G11 and then through two AND gates G12 and G13 for enabling each of memories MEM1A and MEM1B.

A J-K flip-flop FF7 has its respective Q and $\overline{Q}$ outputs connected the other input of each of gates G12 and G13, this flip-flop being clocked by timer CL2. This arrangement is such that the memories are enabled alternately when data is being read from the memories during transfer of data to the central processor system but are enabled simultaneously when such data is being stored.

Such are the various features for storing data in the memories and for causing it to be read from the memories for transmission to the central processor system. A description of features for initiating communications with the central processor and for facilitating transmission of the sensor data and other information follows.

Referring still to FIG. 3C, designated G14 is a 4-input OR gate. Its inputs are interconnected with the address lines of the memories. Accordingly, if during an interrogation cycle, one or more tripped sensors have been detected, the output of gate G14 goes high in response to the storage at an address in the memories of tripped sensor data. The output of gate G14 is but one input of an expanded-input AND gate G15. Other inputs to the latter are provided by designated ones of the sensor address lines, i.e., of the several memory address inputs 301'.

Hence, when the output of gate G14 goes high, the output of gate G15 goes high. An OR gate G16 (FIG. 3D) receives the output of gate G15 as well as the output of an AND gate G17 whose four inputs are provided by the memory address lines. The result is that the input "E" of a 2-input NAND gate G18 goes high and, assuming that data is not being transferred from the memories, gate G18 will preset a flip-flop FF8 causing its Q output to go high.

When the Q output of FF8 is high, it signals XMIT, meaning to initiate a dialing sequence by a conventional multifrequency telephone dialer (not shown). The function of gate G18 is thus also apparent: If during an interrogation cycle, fifteen alarm addresses have been stored in the memories, the output of gate G18 goes high. This also causes flip-flop FF8 to be preset for initiating a dialing sequence. Accordingly, a dialing sequence initiated either at the completion of an interrogation cycle (and there is at least one stored sensor address) or whenever fifteen sensor addresses have been stored, whichever first occurs. The $\overline{Q}$ output of flip-flop provides a signal $\overline{XMIT}$ which is the logical inverse of the signal XMIT.

The Q output of flip-flop FF8 is connected to one of the two inputs of OR gate G19, the output of which is interconnected with the telephone dialer conventional input for initiating dialing. Hence, a signal XMIT from flip-flop FF8 signals the dialer to dial the central processor system via a conventional telephone line. The signal is identified START DIALER (+) as shown. The absence of a signal XMIT, on the other hand, causes an adjacent 2-input NOR gate G20 to signal STOP DIALER (+) for preventing dialer operation.

Clearing of flip-flop FF8 is provided for by the operation of an inverter N11, which receives the output of OR gate G14, and a 3-input NAND gate G24 which receives the output of gate G14 via inverter N11, the $\overline{Q}$ output of flip-flop FF6, and the Q output of flip-flop FF8. This arrangement causes clearing of flip-flop FF8 under circumstances described below.

When the central processor system automatically answers in response to the dialed call described above, the dialer conventionally provides a signal CALL COMPLETED (+) which is supplied to one input of each of a pair of 2-input NAND gates G22 and G23. The other input of G23 is provided with the signal XMIT. Hence, the output gate G23 will cause a flip-flop FF9 to provide at its $\overline{Q}$ output a signal TRANS meaning to transfer data stored in the memories to the central processor system. This signal is provided to AND gate G10 (FIG. 3C) for gating clock pulses from timer CL2.

Operation of the memory data read-out (i.e., data transfer) circuits of FIG. 3C previously described causes data from memory chips MEM1A and MEM1B to be alternately provided to four inverters N6–N9. Hence, the logic-inverted data bits representing digits stored in each of the memory chips are alternately provided to inputs of a 4-input hexadecimal-output demultiplexer circuit DM2. The twelve outputs of the latter circuit povide the twelve dialing digits to a conventional multifrequency telephone dialer tone generator (not shown), these digits being 0 through 9 and "*" and "#". This tone generator may be the same one used for dialing a telephone line to the central processor system.

When the last sensor address has been transmitted, NAND gate G24 output goes high, clearing flip-flop FF8 and stopping further data transmission.

It should be apparent from the foregoing that stored sensor data is thus tone-encoded in a digital format for transmission to the central processor system over a telephone circuit communications link as a sensor alarm data message, each sensor address being represented by two digits which are transmitted serially as multifrequency tones.

System reset functions may be noted, with reference to FIG. 3A, as involving selective operation of pushbutton switch PB1. This causes one-shot OS1 to provide a signal SYSTEM RESET (−) to each of the sensor circuits via data bus driver DR1 and data receiver RR1 for clearing each flip-flop of the sensor circuits corresponding to flip-flop FF5. This signal is also provided to counter CN3 (see FIG. 3C) for clearing it. Hence, pushbutton PB1 is operated for clearing the unit and readying it for operation.

As was noted above, the sensors may be of either intrusion or nonintrusion alarm sensing types, the remote unit being adapted for responding to sensors of both types. For many commercial and industrial subscribers, it is desirable for intrusion alarm sensing to be selective disable or enabled. For example, in either commercial or private premises it may be unnecessary and undesirable to employ intrusion sensing during daylight or business hours but desirable to return to intrusion sensing capability after dark or after close of business. Yet it may be desirable to retain nonintrusion types of sensing (e.g., fire, heat, etc.) even during times when intrusion sensing is disabled. Accordingly, remote units of the system are provided with means for selectively disabling response by the respective remote unit to tripped conditions of intrusion alarm sensing type sensors while permitting response to tripped conditions of nonintrusion alarm sensing type sensors. In this way, the remote unit is provided with only a nonintrusion sensing mode of operation. Features described below also signal the central processor system of such change in mode of operation.

A pushbutton switch PB2 (FIG. 3D) is provided for selectively enabling or disabling the above-described intrusion feature. Its operation toggles a flip-flop FF11 whose Q output, when high, provides signal S.I. (+) meaning "sense intrusion" or whose $\overline{Q}$ output, when high, signals the logical inverse S.I. (−) for terminating intrusion sensing. Either signal is provided through an OR gate G25 for clocking a one-shot OS12. The $\overline{Q}$ output of the one-shot operates to preset a flip-flop FF12. The Q output of FF12 is provided to OR gate G19, hence providing a signal START DIALER (+) whenever the intrusion sense mode is either selectively enabled or disabled, at the subscriber's option.

The Q output of flip-flop FF12 is also provided to NAND gate G22 for presetting another flip-flop FF13, but only after a signal CALL COMPLETED (+) is provided by the telephone dialer signifying that a telephone circuit has been established with the central processor system. The Q output of flip-flop FF13 then causes an AND gate G26 to permit clock pulses from timer CL2 to be provided to one input of each of a pair of AND gates G27 and G28 and a NAND gate G29.

These three gates are controlled by a binary counter chain constituted by two flip-flops FF14 and FF15. Flip-flop FF14 is clocked through gate G26. Hence, operation when intrusion sensing is enabled by operation of switch PB2 is as follows: The counter chain first causes the output of gate G28 to go high, and then causes the output of gate G27 to go high.

Three inverters N12–N14 tie the output of gate G28 to the three memory output lines designated which provide to inverters N6–N9 (FIG. 3C). Hence, when gate G28 output goes high, a first tone is generated by operation of demultiplexer DM2 and the dialer multifrequency tone generator to which it is connected.

Two other inverters N15 and N16 tie the output of gate G27 to memory output lines designated. Hence, when the output of gate G27 goes high, a second different tone is generated by the dialer tone generator. In this way, the central processor system is signalled by digital encoding that sensor intrusion operation has been enabled at the respective remote unit.

Following such operation of first gates G28 and then gate G27, the NAND gate G29 operates to provide a signal S.I. STP, meaning sense intrusion signalling stop, to the reset inputs of each of flip-flops FF14 and FF15 and to the clear input of flip-flop FF12. Accordingly, the intrusion mode signalling circuits are reset and so conditioned for signalling again.

When it is desired to disable the intrusion sensing mode, operation of pushbutton switch PB2 again toggles flip-flop FF11. Accordingly, its output provides the signal S.I. (−), meaning terminate intrusion sensing. This signal is provided to one input of a NAND gate G30 whose output is interconnected with a designated memory output line.

The signal S.I. (−) also clocks one-shot OS12 so that a dialing sequence is again initiated. When the dialer provides the signal CALL COMPLETED (+) to signify readiness of the telephone circuit, the counter chain provided by flip-flops FF14 and FF15 then again causes AND gates G27 and G28 to generate tones by means of demultiplexer DM2 and the dialer tone generator. However, the signal S.I. (−) provided to NAND gate G30 causes these tones to be different from those previously given. In this way, the central processor system is signalled by digital encoding that sensor intrusion operation has been disabled at the respective remote unit.

Various modifications of the system and the remote unit are possible. For example, greater remote unit memory storage may be provided, as well as storage of additional types of data. The sensor interrogating (addressing) may be done in ways different from that described and shown. For example, strobe interrogation may be used for detecting a tripped sensor followed by sequential addressing to identify which of the sensors has been tripped. Or multiplex interrogation may be used to reduce the number of leads running to sensor circuits.

Various forms of readouts or other visual and/or aural indications may be employed for signalling at the remote unit (such as for local security purposes) which of the sensors, if any, has been tripped.

Provision may be made for selectively enabling or disabling blocks of sensors, and reporting to the central processor system to that effect.

In view of the foregoing, it will be seen that the several objects of the invention are achieved and other advantages are attained.

As various changes in addition to those discussed above could be made in the above constructions and methods without departing from the scope of the invention, it is intended that all matter contained in the foregoing description shall be interpreted as illustrative rather than in a limiting sense.

What is claimed is:

1. In a security system for centralized monitoring and selective reporting of alarm conditions at a plurality of distant remote units at corresponding remote premises, said system including a central digital processor system, a communications system for providing a digital communications link between said central processor system and any of said remote units, said remote units being individually adapted for responding to a plurality of sensors each having a normal status or a tripped status, said tripped status resulting in response to occurrence of an alarm situation, said central processor system including a data base constituted by segments of stored preselected data associated uniquely with corresponding remote premises, and terminal means for delivering alarm message reports in a format useful for human intervention in such alarm situation, the improvement comprising interrogation means at individual remote units for interrogating said sensors to determine if each sensor has changed from normal status to tripped status, means responsive to detection of such change in sensor status for causing transmission to said central processor system via said communications link of a sensor alarm data message in a digital format signifying the address and tripped status of each tripped sensor, correlation means at said central processor system for logically correlating said sensor alarm data message with said data base to determine logical validity or invalidity of said sensor data message, and means responsive to a logical validity determination be said correlator means for causing at least portions of said sensor data message and corresponding segments of said data base to be assembled into an alarm message report for delivery by said terminal means.

2. In a security system as set forth in claim 1, said interrogation means being adapted for interrogating each of a plurality of said sensors during repeating interrogation cycles.

3. In a security system as set forth in claim 1, each remote unit comprising at least one memory means for storing information indicative of a tripped sensor.

4. In a security system as set forth in claim 3, said memory means being adapted for storing sensor data signifying the address of each tripped sensor.

5. In a security system as set forth in claim 1, said remote units being adapted for responding to sensors of both an intrusion alarm sensing type and a non-intrusion alarm sensing type, the improvement further comprising means for selectively disabling response to sensors of said intrusion alarm sensing type sensors while permitting response to sensors of said non-intrusion alarm sensing type, thereby providing only a non-intrusion alarm sensing mode.

6. In a security system as set forth in claim 1, said interrogation means of each remote unit being adapted for interrogating said sensors during each of periodically repeating interrogation cycles, said means responsive to detection of change in sensor status including a counter for counting up the number of tripped sensors determined during said interrogating of said sensors, and said means responsive to detection being alternately responsive either upon the count in said counter reaching a predetermined number of tripped sensors, or at the end of an interrogation cycle during which there is detection of less than said predetermined number of tripped sensors during an interrogation cycle, whichever first occurs, for causing said transmission to said central processor system.

7. In a security system as set forth in claim 1, wherein said communications link comprises a telephone circuit, said means responsive to change in sensor status comprising means for establishing said telephone circuit between the respective remote unit and said central processor system.

8. In a security system for centralized monitoring and selective reporting of alarm conditions at a plurality of distant remote units at corresponding remote premises, said system comprising:

a central digital processor system for digitally processing information received from remote units;

a communications system adapted for providing a digital communications link between said central processor system and any of said remote units;

said central processor system having a plurality of input ports to provide for simultaneous receipt of alarm data from more than one of said remote units;

a data base at said central processor system constituted by segments of stored preselected data, corresponding segments being indicative of characteristics associated uniquely with corresponding remote premises;

said remote units being individually adapted for responding to a plurality of sensors each having a normal status or a tripped status, said tripped condition resulting in response to occurrence of an alarm situation;

said central processor system having at least one output port to provide for delivery of alarm reports to an output terminal device in a format useful for human intervention in such alarm situation;

the improvement comprising:

interrogation means at individual remote units for interrogating said sensors for detection of whether any sensor has changed from normal status to tripped status;

memory means at individual remote units for storing sensor data signifying the address and tripped status of each tripped sensor;

communications initiation means at individual remote units, operative upon detection of such change in sensor status, for initiating the establishment of a communications link by said communications system between one of the input ports of said central processor system and the respective remote unit;

encoder means at individual remote units for encoding, when enabled, said stored sensor data in a digital format suitable for transmission over said communications link;

message initiation means at individual remote units, operative upon establishment of a communications link, to enable the encoder means for transmitting said stored sensor data as a sensor alarm data message to said central processor system via said communications link;

message storage means at said central processor system for storing said sensor alarm data message;

correlator means at said central processor system for logically correlating the stored sensor data message with corresponding segments of said data base to determine logical validity or invalidity of said sensor alarm data message;

invalid message processing means responsive to a logical invalidity determination for signalling that said sensor alarm data message is erroneous; and valid message processing means responsive to a logical validity determination for causing at least portions of said sensor alarm data message and corresponding segments of said data base to be assembled into an alarm message.

9. In a security system as set forth in claim 8, said interrogation means being adapted for interrogation a plurality of said sensors sequentially in periodically repeating interrogation cycles.

10. In a security system as set forth in claim 9, said interrogation means comprising a source of pulses, a binary counter for counting said pulses up to a predetermined number and then resetting to determine an interrogation cycle, decoder means for decoding the count in said counter, the decoded count representing the address of a sensor, address response means interconnected with each sensor for responding to a decoded count representing the address of the respective sensor, and detection means responsive to said address response means and to the tripped status of the respective sensor for causing said memory means of the respective remote unit to store the address of the tripped sensor.

11. In a security system as set forth in claim 10, said memory means at individual remote units comprising at least one random access memory.

12. In a security system set forth in claim 11, said communications initiation means comprising telephone dialer means for dialing a telephone number to establish a telephone circuit constituting said communications link.

13. In a security system as set forth in claim 12, said message initiation means being responsive to establishment of said telephone circuit to enable said encoder means to encode said sensor data stored in said random access memory for transmission of said stored data over said telephone circuit.

14. In a security system as set forth in claim 13, said encoder means being adapted for encoding said stored sensor data into different tones representative of different digits corresponding to respective tripped sensor addresses, said tones being transmittable over said telephone circuit.

15. In a security system as set forth in claim 14, said tripped sensor addresses being transmitted in the form of said tones in a sequence until all of said sensor data stored in said random access memories is transmitted over said telephone circuit.

16. In a security system as set forth in claim 15, each said random access memory of a respective remote unit being interconnected with said binary counter of the respective remote unit for identifying sensor addresses, each said remote unit comprising a further binary counter interconnected with said random access memory, the last said counter determining memory storage addresses of data stored in said memories.

17. In a security systen as set forth in claim 8, said communications system being telephonic, said communications initiation means being adapted for establishing a telephonic link between said central processor system and a respective remote unit, said encoder means being adapted for encoding said stored sensor data into different tones representative of different tripped sensor addresses, said tones being transmittable via said telephonic link.

18. In a security system as set forth in claim 8, said remote units being adapted for responding to sensors of both an intrusion alarm sensing type and a non-intrusion alarm sensing type, the improvement further comprising means at remote units for selectively disabling response by a respective remote unit to tripped conditions of intrusion alarm sensing type sensors while permitting response to tripped conditions of non-intrusion alarm sensing type sensors, thereby to provide only a non-intrusion sensing mode, and means for causing said encoder means at remote units for encoding in a digital format sensing mode signals representative of whether or not said response is selectively disabled, said sensor mode signals being adapted for transmission to said central processor system.

19. In a method of centralized monitoring and selective reporting of alarm conditions at corresponding remote premises, said method including providing each of a plurality of said remote premises with respective remote units and a plurality of sensors each having a normal status or a tripped status, said tripped status resulting in response to an alarm situation, providing a central processor system including data base storage, storing in said data base storage segments of preselected data associated uniquely with corresponding remote premises, providing a digital communications link between said central processor system and any of said remote units, the improvement comprising electronically interrogating said sensors to determine if any sensor has changed from normal status to tripped status, electronically detecting such change in sensor status and, in response to such change, electronically transmitting a sensor alarm data message in a digital format signifying the address and tripped status of each tripped sensor to said central processor system via said communications link, electronically correlating, by means of said central processor system, said sensor alarm data message with said data base to determine logical validity of said sensor alarm data message, and causing, by means of said central processor system, at least portions of said sensor alarm data message and corresponding segments of said data base to be provided as an alarm message report in a format useful for human intervention in such alarm situation.

20. In a method as set forth in claim 19, the further improvement comprising electronically storing, by means of said remote unit, data signifying the address and tripped status of each tripped sensor in response to said detecting change in sensor status.

21. In a method as set forth in claim 20, said electronically transmitting a sensor alarm data message comprising transmitting the electronically stored data.

22. In a method as set forth in claim 21, the further improvement comprising electronically initiating communications readiness of said digital communications link prior to said transmitting a sensor alarm data message.

23. In a method as set forth in claim 19, said alarm message report being provided only if said logical validity of said sensor alarm data message is determined to exist.

24. In a method as set forth in claim 23, the improvement further comprising electronically signalling if logical invalidity of said alarm data message is determined to exist.

25. In a method as set forth in claim 19, wherein said sensors of a remote unit are of intrusion alarm sensing types and of non-intrusion alarm sensing types, the improvement further comprising selectively disabling determination of the tripped status of intrusion alarm sensing type sensors, thereby providing only a non-intrusion alarm sensing mode.

26. In a method as set forth in claim 25, the improvement further comprising electronically transmitting a sensing mode signal from a remote unit to said central processor system, signifying said non-intrusion alarm sensing mode, if said disabling is effected.

27. In a method of centralized monitoring and selective reporting of alarm conditions at corresponding remote premises, said method including providing each of a plurality of said remote premises with at least one electronic remote unit and a plurality of sensors associated with said remote unit, said sensors each having a normal status or a tripped status, said tripped status resulting in response to an alarm situation, providing a central processor system including data base storage, storing in said data base storage segments of preselected data associated uniquely with corresponding remote premises, providing a digital communications link between said central processor system and any of said remote units, the improvement comprising:

electronically interrogating, by means of said remote unit, said sensors to determine if any sensor has changed from normal status to tripped status;

electronically detecting, by means of said remote unit, such change in sensor status;

electronically storing, by means of said remote unit, data signifying the address and tripped status of each tripped sensor;

electronically initiating, by means of said remote unit, communications readiness of said digital communications link upon detection of such change in sensor status;

thereafter electronically encoding, by means of said remote unit, said stored sensor data in a digital format suitable for transmission over said communications link; and electronically transmitting, by means of said remote unit, said encoded sensor data as a sensor alarm data message to said central processor system via said communications link;

electronically storing the received sensor alarm data message at said central processor system;

thereafter electronically logically correlating, by means of said central processor system, the stored sensor data message with corresponding segments of said data base to electronically determine logical validity or invalidity of said sensor alarm data message; and then either electronically signalling, by means of said central processor system, upon electronically determining that said sensor data message is logically invalid, that said data message is erroneous; or electronically causing, by means of said central processor system, upon electronically determining that said sensor data message is logically valid, at least portions of said sensor data message and corresponding segments of said data base to be provided as an alarm message report in a format useful for human intervention in such alarm situation.

* * * * *